US005275394A

United States Patent [19]

Mank et al.

[11] Patent Number: 5,275,394

[45] Date of Patent: Jan. 4, 1994

[54] DEVICE FOR FORMING A TRAIN OF UNDERLAPPING ARTICLES

[75] Inventors: Klaus Mank, München; Luitpold Klüber, Zusmarshausen-Streitheim, both of Fed. Rep. of Germany

[73] Assignee: Georg Spiess GmbH, Gersthofen, Fed. Rep. of Germany

[21] Appl. No.: 829,327

[22] Filed: Feb. 3, 1992

[30] Foreign Application Priority Data

Mar. 15, 1991 [DE] Fed. Rep. of Germany ..... 4108397

[51] Int. Cl.[5] ..... B65H 29/68

[52] U.S. Cl. ..... 271/183; 271/202; 271/203; 271/216

[58] Field of Search ..... 271/182, 183, 188, 197, 271/202, 203, 216, 270

[56] References Cited

U.S. PATENT DOCUMENTS

| | | | |
|---|---|---|---|
| 3,595,564 | 7/1971 | De Young | 271/183 |
| 4,136,865 | 1/1979 | Marass | 271/183 X |
| 4,139,190 | 2/1979 | Keyt et al. | 271/183 |
| 4,302,001 | 11/1981 | Liepert | 271/202 X |
| 4,886,263 | 12/1989 | Naito | 271/183 X |
| 4,905,981 | 3/1990 | Reist | 271/202 X |

*Primary Examiner*—Robert P. Olszewski
*Assistant Examiner*—Boris Milef
*Attorney, Agent, or Firm*—Jones, Tullar & Cooper

[57] ABSTRACT

A device for the formation of a train of underlapping sheet-like articles and more particularly for the formation of an overlapped stream during conveying sheets cut by a preceding transverse cutter device from a web of paper to a feed table of a paper processing machine, comprising a holding up device arranged over a belt arrangement and with which the trailing part of the successively moving articles is able to be moved into engagement with the formation of an inlet gap for the respectively following article and more particularly by means of an associated lifting device, is able to be brought into engagement, and a draw off device following the belt arrangement and adapted to be driven at the same speed as the overlapped stream. The belt arrangement is designed in the form of a drag device with circulating entraining belts adapted only for engagement of the consecutively moving articles at the leading edge thereof. The holding up device comprises a brake device with circulating holding belts adapted for engagement with the trailing ends of the consecutively moving articles, such holding belts being adapted to be driven at an adjustable speed which initially is equal to the conveying speed of the entraining belts of the belt arrangement and then may be reduced therefrom to be equal to the speed of the overlapping stream.

24 Claims, 5 Drawing Sheets

1
2
3
4
5
6
4a
4b
4c
7
8
8a
8b
9
10
10a
10b
11
19
20
21
35
55
56

DEVICE FOR FORMING A TRAIN OF UNDERLAPPING ARTICLES

BACKGROUND OF THE INVENTION

The invention relates to a device for the formation of a train of underlapping sheet-like articles and more particularly for the formation of an overlapped stream during conveying sheets cut by a preceding transverse cutter device from a web of paper to a feed table of a paper processing machine. The device comprises a holding up device arranged over a belt arrangement and with which the trailing part of successively moving articles is able to be moved into engagement with the formation of an inlet gap for the respectively following article, and more particularly by means of an associated lifting device, is able to be brought into engagement, and a draw off device following the belt arrangement, the draw off device being adapted to be driven at the same speed as the overlapped stream.

A device of this type has been described in German patent publication 2,902,447 C3. In the case of this known device the holding up device only comprises a stationary suction box. In the case of the belts of the belt arrangement placed underneath the suction box it is a question of simple conveying belts, on which the sheets to be conveyed are simply rested under their own weight. Here there is no positive entrainment of the sheets. The holding up device in the form of a stationary suction box may in this case therefore only come into operation when the respective sheet has already been gripped by the following draw off device and accordingly has been slowed down to the speed of the overlapping stream. Therefore there is the danger of the sheet which is practically pushed along by the belt arrangement, running at a high speed onto the drawing off device, something which would lead to damage of the leading edge of the sheet and to irregular operation. This risk becomes increasingly serious with a greater speed of the machine. Furthermore in the known arrangement there is the danger of relative movement between the belts of the belt arrangement and the sheets simply resting thereon under their own weight, this also being a likely cause of troubling conditions and damage, more particularly in the case of high machine speeds.

SUMMARY OF THE INVENTION

Taking this state of the art as a starting point one object of the present invention is therefore to provide a device of the type initially mentioned in the case of which, using simple and inexpensive means, there is such an improvement that at high machine speeds gentle product handling is possible.

A still further object of the invention is to provide such a machine which is capable of highly precise operation.

In order to achieve these and/or other objects, of the present invention the belt arrangement is designed in the form of a drag device with circulating entraining means adapted only for engagement of the consecutively moving articles at the leading edge thereof, and the holding up device comprises a brake device with circulating holding means adapted for engagement with the trailing ends of the consecutively moving articles, such holding means being adapted to be driven at an adjustable speed which initially is equal to the conveying speed of the entraining means of the belt arrangement and then may be reduced therefrom to be equal to the speed of the overlapping stream.

These features lead to the advantage of a slowing down by braking of the overlapping stream even prior to their transfer to the draw off device moving at the slow speed of the overlapping stream. This means that there is an effective way of preventing damage of the leading edge. A further point to be considered is that the formation of the inlet gap for the respectively following article takes place even prior to the transfer of the preceding article to the slower draw off device, thus leading to short cycle times and accordingly high machine speeds.

In accordance with a further possible advantageous development of the invention it is possible for the belts of the belt arrangement to be driven at a speed which may be varied over their circuit so that the speed is able to be set starting at a value equal to the speed of the arriving articles increasing to a higher conveying speed than the speed of the arriving article and thereafter is set to a return speed responsible for a synchronization of the entraining means with the arriving articles. These features are responsible for the advantage of a jerk-free sheet transfer while allowing for a very high conveying speed and accordingly particularly short cycle times and consequently a particularly high machine speed.

In accordance with a particularly advantageous feature of the invention the belt arrangement comprises a plurality of sets of belts and more particularly two thereof, which are able to be driven independently from each other with respectively the same speed but with an offset in time, the entraining means thereof being adapted to be alternately brought into engagement with the consecutively moving articles respectively. An alternate operation of this type leads as well to the useful advantage of simpler control of the drive means associated with the belts of the belt arrangement, even in the case of very short cycle times, and simultaneously ensures high precision as regards the synchronization of the entraining means with the respectively associated articles.

A further advantageous feature of the invention results from the fact that that the belts of the drag device are in the form of suction belts, which over their periphery are only in part provided with suction holes in the form of at least one suction hole group. Such features lead to an arrangement which is particularly simple in construction and treats the product gently and furthermore possess the advantage of doing without mechanical gripping means etc. Nevertheless there is a reliable engagement and entrainment of the articles to be conveyed. A further advantage is that the articles moved by the drag device are relatively softly engaged and released since the effective suction orifice is automatically diminished at the start and automatically increased at the end of the drag path. This effect may be made even more precise by suitable features, as for instance by subdivision of the suction ducts along the drag path.

It is an advantage if the suction belts comprising the drag device are able to be positively driven and for this purpose are preferably in the form of gear belts with inwardly directed teeth. This feature ensures a high degree of precision despite the necessary acceleration and retardation of the belts comprising the drag device.

It is convenient if the suction belts of the drag device project at their suction groups. This feature is more particularly preferred in the case of the use of a plurality of belt sets with mutually offset entraining means, since then contact between articles moved by the respectively activated belt set and the belts of the other belt set is avoided.

It is furthermore an advantage if the belts of the drag device are provided with repelling humps projecting upwards and preceding their entraining means. These repelling humps maintain a gap open even in the case of a sagging sheet so that the respectively following sheet may be drawn in by the entraining means of the drag device.

In accordance with a further possible advantageous development of the invention it is possible for the draw off device to be in the form of a pair of rolls with a gripper gap delimited by mating rolls driven by drive rolls and preferably adapted to be resiliently pressed, the belts of the drag device being set to be lower than this gap. These features ensure a reliable passing on of the overlapping stream formed by the preceding stream forming device.

In the case of a further advantageous embodiment of the invention it is possible for the holding means of the braking device to comprise drivable circulating suction belts provided over their full periphery with suction holes. In this case there is the advantage of a simple automatic control so that the suction holes move past the end of the associated suction box bit by bit. Simultaneously the use of suction belts renders possible simple matching of the speed of the brake device to the speed of the belts of the drag device.

It is convenient if the suction belts of the brake device comprise positively driven belts, preferably in the form of gear belts with inwardly directed teeth, this ensuring high precision without loss owing to slip.

In accordance with a further development of the invention it is possible for the holding up device to have a suction box following the braking device and arranged to be stationary in operation. This feature renders it possible to keep the inlet gap open even after termination of the braking operation.

In the case of the use of a separate lifting device it is possible for the entire holding up device including the braking device comprising a part thereof to be arranged to be stationary in operation, something which is responsible for freedom from vibration even in the case of a large machine width.

In order to ensure versatility with respect to the range of sheet sizes which may be processed it is possible for the entire holding up device and any lifting device following the same to be adjustable to suit the sheet size.

Further advantageous developments and convenient forms of the invention will be gathered from the following detailed account of some embodiments thereof in conjunction with the accompanying drawings.

DETAILED DESCRIPTION OF THE PREFERRED EMBODIMENTS OF THE INVENTION

Figures 1, 2:
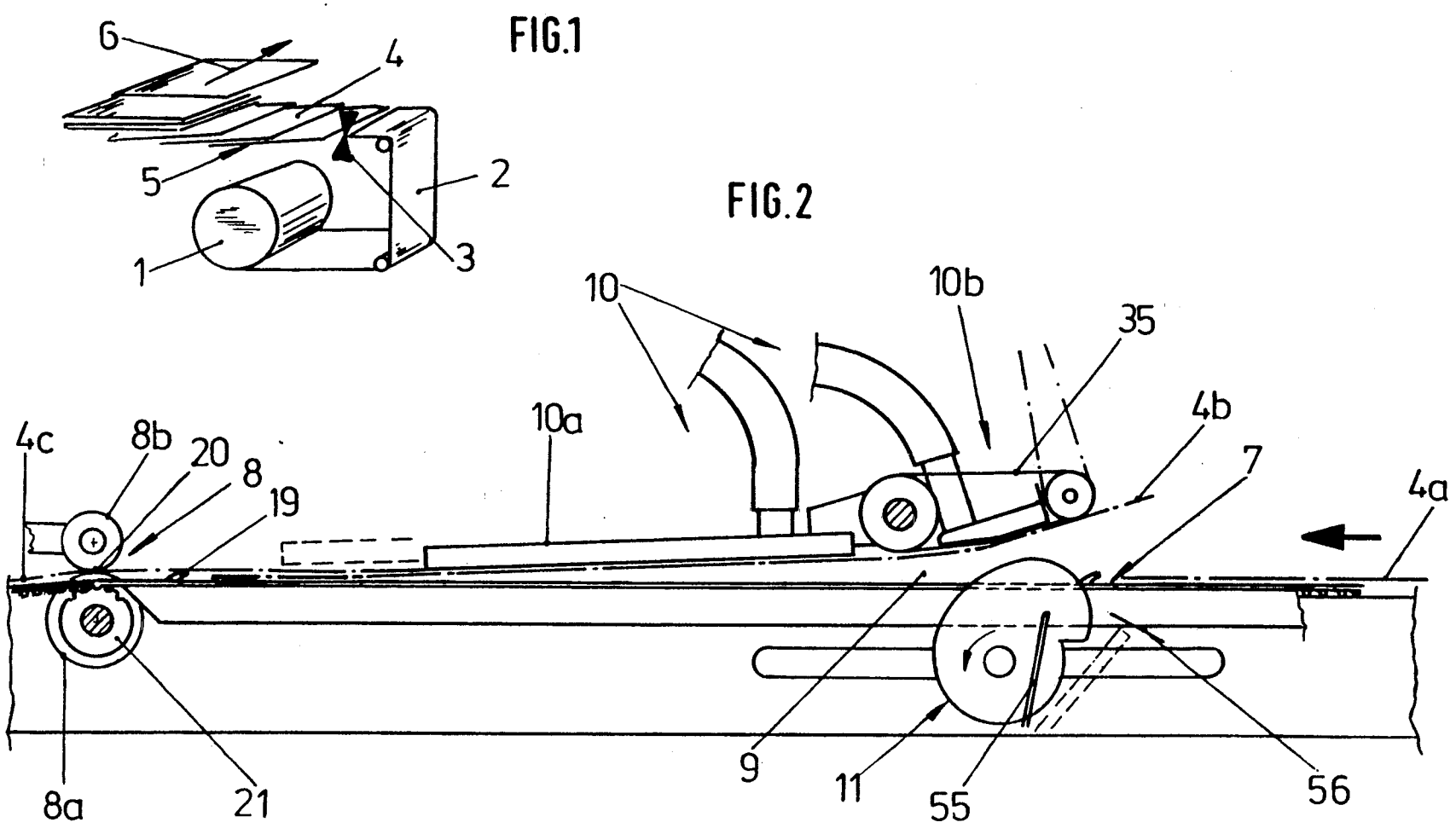
FIG. 1 shows a diagrammatic elevation of a web to sheet converter preceding a sheet feed printing press.
FIG. 2 is a diagrammatic elevation of a device for producing an overlapping stream in accordance with the invention.

A sheet processing machine such as a sheet feed printing press is fed with sheet material in a known manner in the form of an overlapping stream, which is produced during the processing of stacks of sheets. In many cases it is however desirable to be able to handle web material in sheet feed equipment as well. For this purpose, as shown in FIG. 1, a paper web 2 is unwound from a roll 1 and from the web 2 sheets 4 are cut by a transverse cutting device 3. These sheets are combined to constitute an overlapping stream 5 by a device which is to be explained further below. The sheets may be directly introduced, or as indicated at 6 after a suitable change in direction, into a sheet feeder, which passes the fed sheets one by one into a sheet processing machine.

The above described device for producing an overlapping stream comprises, as shown in FIG. 2, a belt arrangement 7 following a transverse cutter (not illustrated in detail) and serving to so remove the sheets cut off from the paper web that the respectively following next sheet **4*a* is so removed that its leading edge is dragged under the trailing end of the respectively preceding sheet 4*b*. For this purpose there is firstly an acceleration of the sheet entrained by the belt arrangement 7 in relation to the speed of the paper web. After this there is a retardation down to the speed of the overlapping stream. This speed is set by a draw off device 8, which is arranged at the front end of the overlapping stream path moved which along moves the path that the belt arrangement 7** moves.

An inlet gap 9 for the leading end of the respectively following sheet **4*a* is formed by the trailing end of the respectively preceding sheet 4*b* which is lifted in relation to the conveying plane of the belt arrangement 7. Simultaneously there is a retardation of the respectively preceding sheet 4*b* to the speed of the overlapping stream so that the respectively following sheet 4*a* is shot into the inlet gap. For this purpose a holding up device 10 is provided over the belt arrangement 7, such holding up device functioning to aspirate and to hold up the underlying sheet, in the present case the sheet 4*b*, and simultaneously to slow it down to the same speed as the overlapping stream. In the illustrated working embodiment of the invention the holding up device 10 consists of two tandem-arranged units in the form of a suction box 10*a* having a fixed suction group and a braking device 10*b* preceding the same with a moving braking member. In order to bring the respective sheet, such as in the present case the sheet 4*b*, into engagement with the holding up device 10, the same may move upwards and downwards partly or completely in step with the sheet to be lifted. In the illustrated working embodiment of the invention for this purpose there is a lifting device 11, which moves the respectively lifted sheet into engagement with the holding up device 10, which in this case may be arranged to be stationary. The lifting device may comprise a blowing or, in the present case, a patting device acting from below, or an upwardly sucking device acting from above. In addition or as an alternative it is possible, as already mentioned, to design the brake device 10***b* to perform a corresponding lifting movement.

Figure 3:
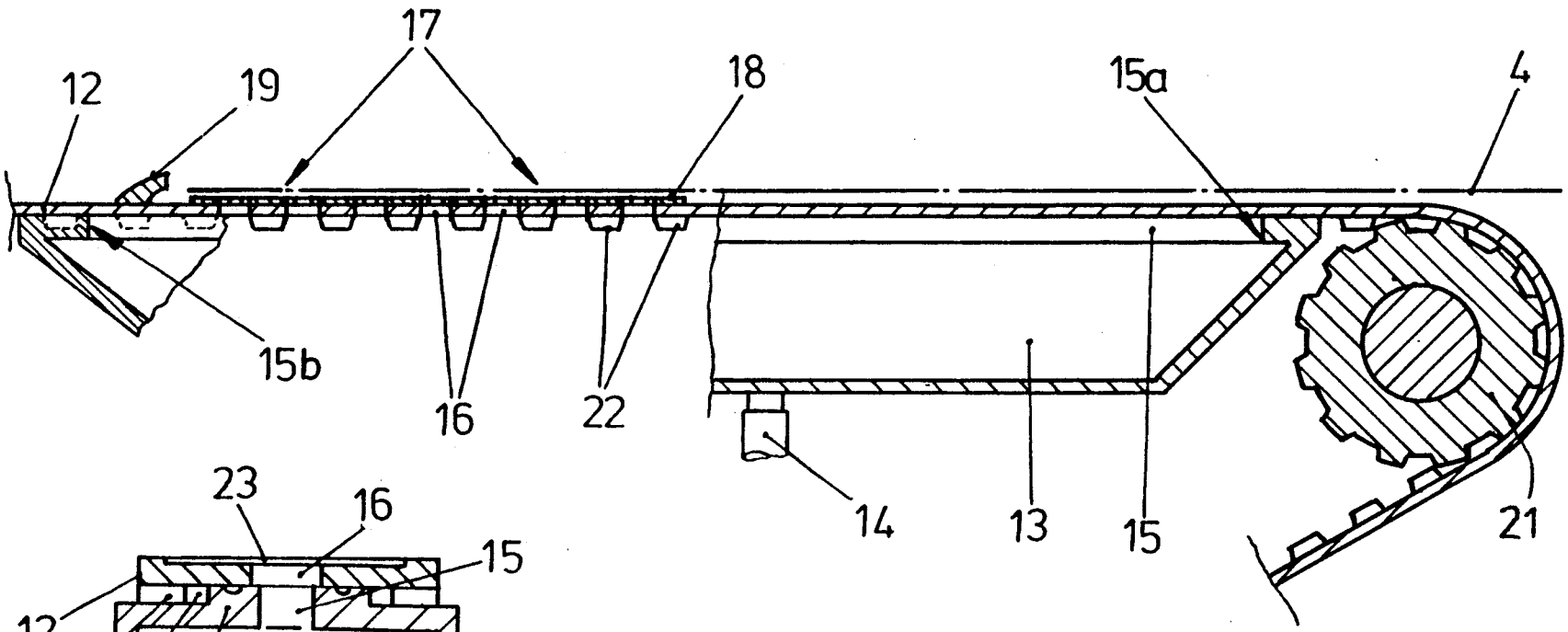
FIG. 3 is a longitudinal section taken through a suction belt of the drag device of the device in accordance with the invention for producing an overlapping stream of products.

The belts of the belt arrangement 7 comprise suction belts 12 of the type best seen in FIG. 3. Each such suction belt 12 is provided with a suction duct 13 in the form of a hollow section, on which the upper run of the respective suction belt 12 lies. All the suction ducts 13 of the belt arrangement 7 are connected via a common header or, as in the present case, via individual lines 14 with a source of vacuum, not illustrated. Each hollow section of the suction duct 13 is provided in its upper wall with a preferably central opening which in the present case is in the form of a slot 15 or of a line of holes etc. The suction belts 12 are however not provided with suction holes 16 along the full lengths thereof but only along a part thereof. The result is suction hole groups 17 which are evenly spaced out over the periphery and with a distance between them. The suction hole groups comprise entraining means, which at their leading end hold sheets coming into engagement with them and may convey them with a drag effect. The belt arrangement 7 functions accordingly as a drag device, by which the sheets 4 are conveyed with a drag action.

The suction hole groups 17 serving as entraining means may have a length of 150 to 250 mm or more particularly 200 mm. Between the individual suction hole groups the suction belts 12, as shown in FIG. 3, are free of suction holes. In the suction hole groups 17 it is possible for the suction belts 12, as shown in FIG. 3 as well, to have a projecting part 18. Therefore there is a high level of the engaged surface of the sheet 4 contacted by the respective suction group 17, this more particularly being desired if the suction device has a plurality of suction belt sets alternatingly put into operation. Owing to the projecting parts 18 the latter do not come into contact with the sheets dragged along by the respectively other belt set so that different speed laws or functions are possible which are offset with respect to each other in time without any risk of damage.

In the illustrated working embodiment of the invention the suction belts 12 are provided with upwardly projecting repelling humps 19 which are arranged adjacent to the leading end of the suction hole groups 17. Even in the case of sagging of the overlying sheet, for instance in the leading end part, adjacent to the draw off device 8, of the active drag path of the belt arrangement functioning as a drag device, such a repelling hump 19 ensures, as clearly shown in FIG. 2, a sufficient free space for a following sheet (in the present case the sheet 4*b*) dragged from behind and underlapping the sheet 4*c* already in engagement with the draw off device 8. The repelling humps 19 may comprise bulges molded on the suction belts 12 and preceding the suction hole groups. The suction belts 12 run into the draw off device 8 and, as shown in FIG. 2 as well, in the case of a gripper gap 20 the suction belts 12 are lower than the gripper gap, at least by the height of the humps 19, that is to say they do not strike the elements forming the gripper gap 20, such elements here comprising driven drive rolls 8*a* and nip rolls 8*b* resiliently pressed thereagainst. Simultaneously there is therefore a ramp edge as well for the arriving sheets. In order to ensure the desired lowering of the belt adjacent to the draw off device 8 there is a bend or a deflection of the belt, in which respect it is possible to have bend elements 21 which are coaxial to the drive rolls but have a smaller diameter, as shown in FIG. 2.

The length of the active drag path of the belt arrangement 7 serving as a drag device is dependent on the length of the suction opening, which here is in the form of the central slot 15, of the suction ducts 13. There is then an automatic control of the suction hole groups 17 functioning as entraining means in such a manner that the same are activated when their suction holes 16 pass over the rear end, indicated at 15*a* in FIG. 3, of the suction opening and are passivated when their suction holes 16 run over the leading end of the suction opening as indicated at 15*b* in FIG. 3. At 15*a* there is accordingly the transfer of a sheet, which is released again at 15*b*. The sheets arriving at the transfer position 15*a* run at the speed of the paper web 2. In order to ensure a jerk-free transfer of the sheets, the suction belts 12 at the time of transfer of a sheet run at the same speed as the paper web 2. Once transfer of a sheet has taken place there is an acceleration to a higher speed of conveying so that between the consecutively moving sheets gaps are formed. It is at this speed that the suction hole groups, serving as entraining means, pass over the leading release position 15*b*. Simultaneously the sheet released in this manner is however so held at its trailing end by means of the brake device 10*b* that there is a retardation in the speed of the overlapping stream set by the draw off device. After a sheet has been released at the release position 15*b*, there is a return movement of the respective suction belts 12 in such a manner that the next suction hole group 17 arrives at the transfer position 15*a* in phase with the respectively associated sheet. This return movement may be faster or slower than the conveying speed. The suction belts 12 of the belt arrangement 7 are accordingly driven at a varying speed about their circuit so that there is a variation in speed in accordance with a predetermined speed law.

In order provide a high accuracy of positioning of the suction hole groups 17 serving as entraining means, despite the necessary acceleration and retardation of the suction belts 12, that is to say to prevent slip losses, the suction belts 12 are, as shown in FIGS. 2 and 3 as well, comprise gear belts with inwardly directed teeth 22. The drive and bend or idler rollers 21 are in the form of tooth belt wheels. Owing to the positive engagement due to this there is no slip loss. The outer side of the belt acts as a flat support surface.

Figure 4:
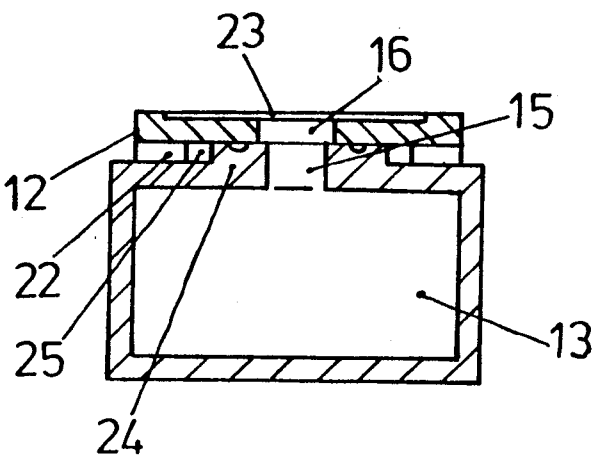
FIG. 4 is a cross section taken through a suction belt of the drag device of the overlapping stream device in accordance with the invention.

In order to ensure minimum resistance to movement it is only necessary, as best shown in FIG. 4, to provide suction holes 16 at the center of the belt, which are in communication with a central suction opening, here in the form of a slot 15, of the associated suction duct 13. In order to increase the effective suction area on the sheet there are, as shown in FIG. 4 as well, superficial recesses 23 adjacent to the suction hole groups 17 which are wider than the suction hole and into which the suction hole 16 open.

The suction opening, here in the form of the slot 15, is delimited by lateral sealing strips 24, on which the respectively associated suction belt 12 runs. In order to improve the sealing effect it is possible for the sealing strips 24 to be provided with expansion grooves. Clear of the sealing strips 24 there are lateral grooves 25 for the teeth 22 of the respectively associated suction belt 12 to run in. They accordingly do not extend over the full breadth of the belt but only constitute two laterally external rows of teeth. It would naturally be possible as well to have a central row of teeth running in a central groove, which would be delimited by two sealing strips on the outside. Although in this case there would be a large breadth to the tooth, there would however simultaneously be an increase in the resistance to movement. In the case of the embodiment of the invention illustrated in FIG. 4 there is less resistance to running than this.

Figure 5:
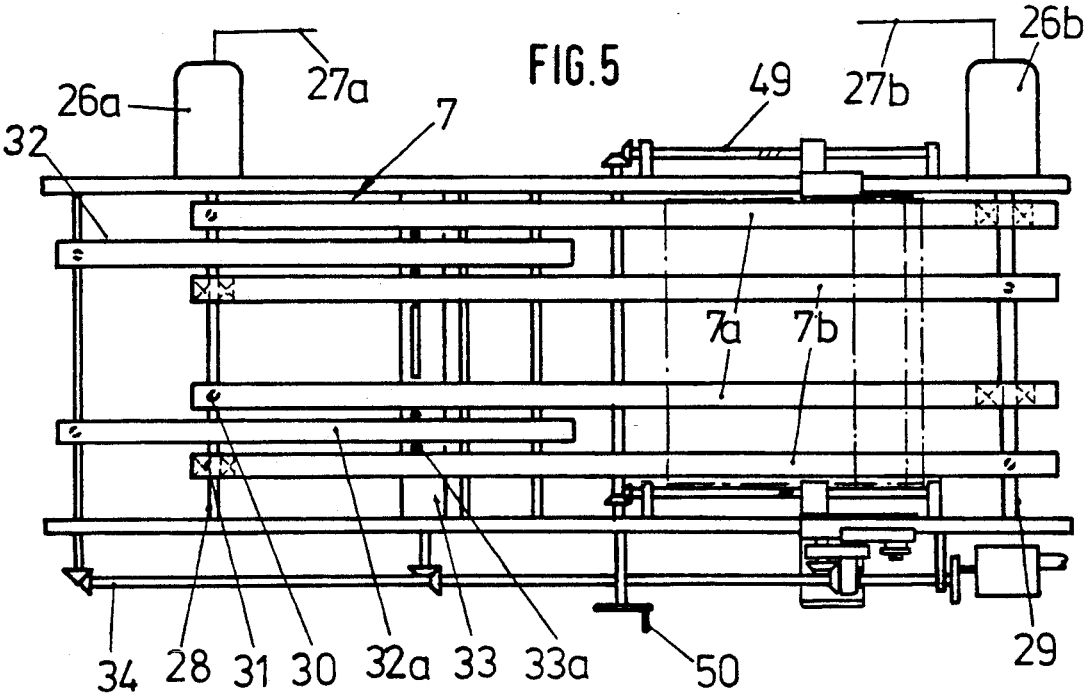
FIG. 5 is a plan view of the drag device of the system in accordance with the invention for producing an overlapping stream of products.

The belt arrangement 7 serving as a drag device may, as already mentioned, comprise a plurality of alternatingly operating belt sets, whose speed laws are offset in time. In the case of the example illustrated in FIG. 5 the belt arrangement 7 has two suction belt pairs 7*a* and 7*b* respectively each constituting a belt set, which are operated alternatingly, that is to say their speed laws are so offset in time and their suction hole groups 17, functioning as entraining means, are so offset in relation to each other in space that the consecutively moving sheets are alternately engaged by one or the other belt pair 7*a* and 7*b* respectively. Each belt pair 7*a* and 7*b* is, as shown in FIG. 5 as well, provided with its own drive motor 26*a* and 26*b*. The two drive motors 26*a* and 26*b* are in this respect so controlled by means of a respectively associated control line 27*a* and 27*b* that the desired speed law and the desired offset thereof are produced. The drive motors 26*a* and 26*b* are respectively connected with a shaft 28 and, 29 mounting the front and the rear bend member of the suction belts belonging to each belt seat. On each shaft 28 and 29 there is a bend member associated with the one belt set, as shown at 30, and the bend member associated with the respectively other belt set is freely rotatable, as shown at 31. The bend members secured to the respectively associated shaft function in this respect as drive wheels, while the freely rotatable bend members only operate as bend wheels. It is more particularly in the case of the arrangement of the present type with alternatingly operating belt sets that, as already mentioned, the belt humps 18 provided adjacent to the suction hole groups 17, have a valuable effect since they ensure that the other belts moving at a different speed than the sheets 4 resting on such a projecting part do not rub on the lower side of the sheet.

In the case of the embodiment of the invention illustrated in FIG. 5 there is a draw off device 32 free of any nip. In this respect it is a question of a belt arrangement arranged following the belt arrangement 7 serving as a drag device, and having a plurality of conveying belts 32*a* running evenly at the speed of the overlapping stream. They may comprise suction belts with suction holes provided over their entire periphery. For the transfer of the sheets fed by the belt arrangement 7 serving as a drag device to the draw off device 32 at this point the belts of the belt arrangement 7 go below the conveying plane of the belts of the belt arrangement constituting the draw off device. For this purpose the belts of the belt arrangement 7 are bent downwards at a bend point. In order to increase the accuracy of the transfer it is possible to provide a roller 33 at the connection between the two conveying planes, against which the leading edges of the arriving sheets braked by means of the braking device 10*b* of the holding up device 10 are able to run. The abutments 33*a* move at the speed of the belts 32*a* and accordingly at the same speed as the overlapping stream as well.

The draw off device 32 and the roller 33 provided with abutments are, as shown in FIG. 5 as well, driven by means of a lateral longitudinal shaft 34, which is driven through an intermediate step down transmission from a so-called one turn shaft, which runs in step with the sheet processing machine. In a similar manner it is possible for the draw off device 8 as shown in FIG. 2 and in the form of a pair of rolls to be driven in the same way. The same goes for the lifting device 11 illustrated in FIG. 2.

The holding up device 10 consists, as has been already mentioned in conjunction with FIG. 2, of a suction box 10*a* extending over the belt arrangement 7 and functioning as the drag device, such box furthermore holding up the engaged sheets upright, while the leading edge thereof is already transferred to the draw off device, and of a braking device 10*b* preceding the suction box 10*a*, that is to say arranged adjacent to it opposite to the direction of conveying and which so slows down the sucked sheets that they enter the drawing device at the same speed as the speed of the overlapping stream.

Figure 6:
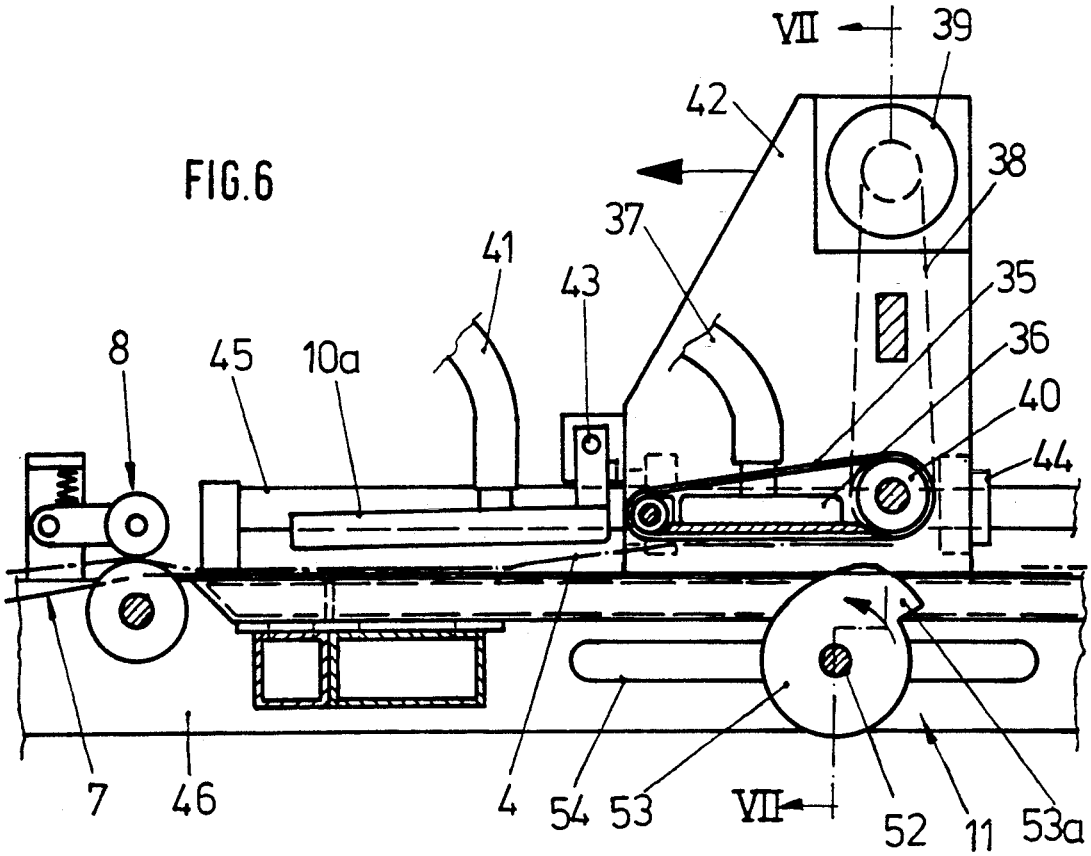
FIG. 6 is a longitudinal section taken through a device in accordance with the invention.
Figure 7:
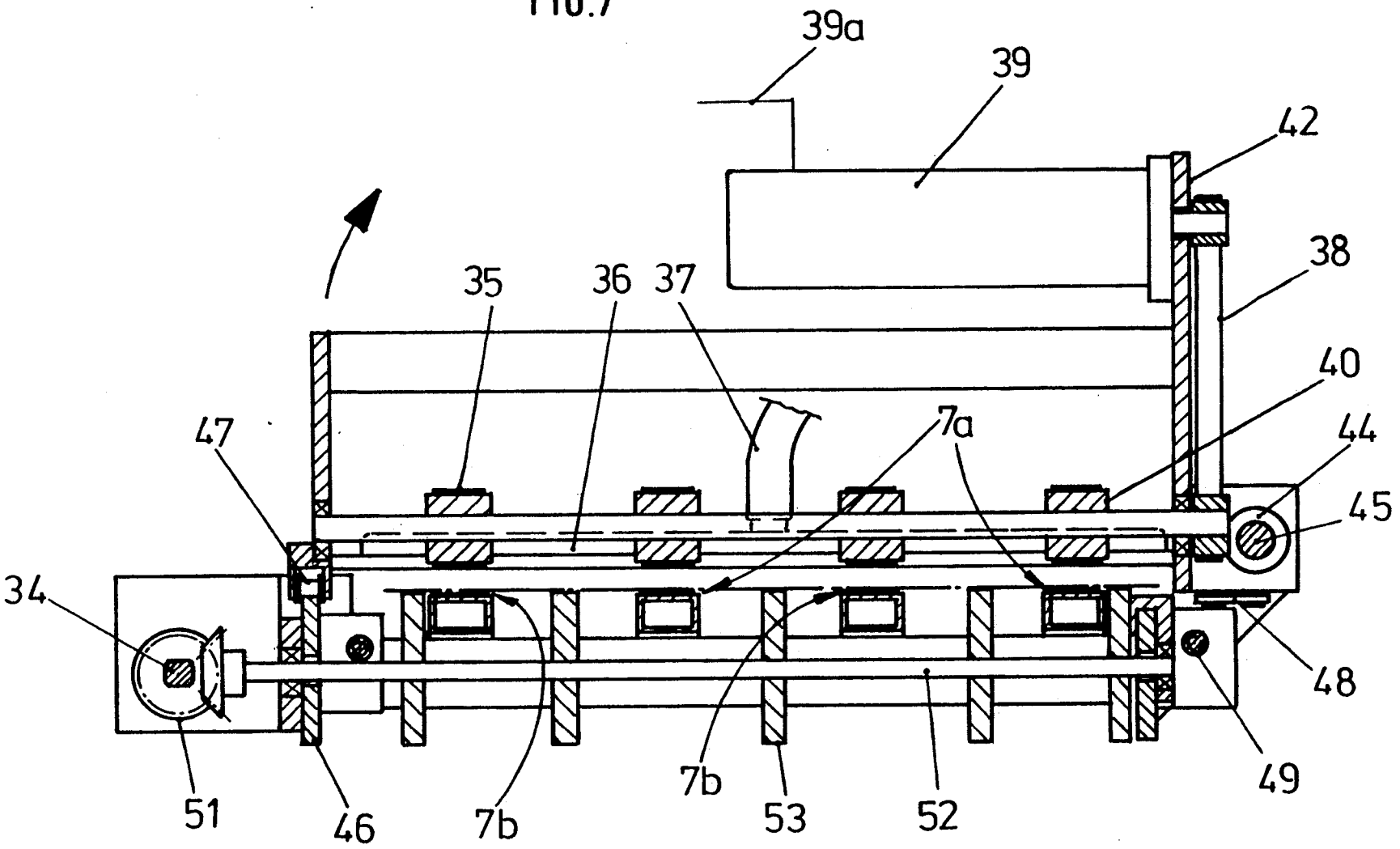
FIG. 7 is a section taken on the line VII—VII in FIG. 6.

The braking device 10*b* is, as best shown in FIG. 6, provided with circulating braking members 35, which come into engagement with the consecutively moving sheets prior to the transfer of the sheets to the draw off device. The circulating braking members 35 may comprise suction belts, which over their entire periphery are provided with suction holes. It is convenient, as shown in FIG. 7, to have a plurality of braking members 35 evenly spaced out over the breadth of the machine. The suction belts constituting the braking members 35 may be provided with individual, connected suction ducts. In the illustrated working embodiment of the invention of FIGS. 6 and 7 there is a common suction box 36 extending over all associated suction belts, connected by the intermediary of a connection duct 37 with a source of vacuum. The suction box 36 is terminated by a floor plate on which the lower run of the suction belts constituting the braking members runs and which accordingly adjacent to the tracks provided for these suction belts is provided with suction openings in the form of slots or rows of holes.

The circulating suction belts comprising the moving braking members 35 are driven via a transmission 38 by means of an associated motor 39 mounted on the frame of the braking device 10*b* or respectively the holding up device 10. In this respect, like the drive motors 26*a* and 26*b* of the belt sets 7*a* and 7*b* of the belt arrangement 7 serving as the drag device, it is a question of a variable speed motor which may be so operated via a control line 39*a* that the desired speed level may be reached. The lifting device 11 is so adjusted that the trailing end of each sheet 4 is only engaged by the braking members 35 when the associated belts of the drag device have attained a conveying speed exceeding that of the paper web. At this point in time, that is to say therefore at each lifting stroke of the lifting device 11, the braking members 35 of the braking device 10*b* are driven at the same speed as the respectively acting belts of the belt arrangement 7 acting as a drag device. The engagement with a sheet by the braking device 10*b* accordingly occurs free of any jerk. The braking members 35 are so slowed down from the conveying speed that the speed of the overlapping stream is attained when the leading sheet end reaches the draw off device running at the speed of the overlapping stream or shortly before this point in time. Since the suction holes 16 of the suction hole group 17, acting on the sheet at the leading end thereof, towards the end of the drag path run out past the leading end 15*b* of the suction opening of the associated suction duct 13, the sheet released bit by bit therefrom will follow the suction belts of the brake device in this part. The belts of the lower belt arrangement 7 in this case serve only as ramp belts, which move away underneath the respective sheet with a certain speed differential in relation thereto so that the respective sheet enters the draw off device taut but at the same speed as the braking members 35, which in this case is equal to the speed of the overlapping stream. The release of a trailing sheet end by the braking members 35 may accordingly occur, when the associated leading sheet end has already entered the draw off device. The distance of the braking device **10*b* from the draw off device, which in accordance with FIG. 6 is in the form of a pair of rollers, is accordingly equal at the most to the length of the sheet and preferably amounts to somewhat less. After the release of a sheet has been completed by the braking members 35** the latter are again accelerated up to the conveying speed of the drag device so that the next sheet may be transferred without any jerk.

In order to achieve a high speed and to prevent slip losses adjacent to the braking member 35 despite the necessary acceleration and retardation, the suction belts constituting the braking members 35 are designed in the form of gear belts with inwardly directed teeth like the suction belts 12 of the belt arrangement 7. The associated bend members 40 accordingly comprise gear belt pulleys. Furthermore there is adjacent to the transmission 38 as well a positive engagement for torque transmission, also with the aid of a gear belt or the like.

The lower run, coming into engagement with a sheet of the circulating braking members 35, moves in alignment with the lower suction sheet metal part of the suction box **10*a*, which via a connection duct 41 is to be connected with a vacuum source. The slope of the suction box 10*a* and preferably of the braking device 10*b* as well is adjustable. In the embodiment of the invention illustrated in FIG. 6 the suction box 10*a* and the braking device 10*b* are so set that there is a reduction in the conveying direction of the distance from the belt arrangement 7. The suction sheet metal part of the suction box 10*a* constitutes an element which is stationary in relation to the circulating suction belts constituting the braking members 35 and by means of this element the trailing sheet ends are held up, when their leading ends have already entered in the draw off device 8**, this being responsible for the desired tautening of the sheet material.

In order in any case to be able to adjust the already mentioned distance to suit the sheet size or format, of the braking device **10*b* from the leading end 15*b* of the drag path and from the draw off device, located here, the entire holding up device 10 is able to be adjusted in the conveying direction to match the format. For this purpose there is an adjustable carriage 42 mounted on longitudinal guides extending parallel to the plane of the belt arrangement 7, and the braking device including the braking members and the drive motor are mounted on the carriage. As shown in FIG. 6, the suction box 10*a* is pivotally mounted with the aid of a pivot bearing 43, and is able to be locked at different angular settings. The carriage 42 is mounted by means of guide bushing 44 on a lateral guide rod 45, which is mounted on a longitudinal beam of the frame 46 for the belt arrangement 7. On the other longitudinal beam of the frame 46 the carriage 42 is supported by means of wheels 47. This means that it is possible not only to set the carriage 42, and therefore the complete holding up device 10, in the conveying direction and in the opposite direction, but also to pivot the same upward about the guide rod 45 in order to get access to the belt arrangement 7**, for instance in the case of stoppage of the machine.

The lifting device 11 is adjustable together with the braking device **10*b*. For this purpose it is possible for the lifting device 11 to be mounted on the carriage 42 as well. In the case of the arrangement illustrated in FIG. 7 the lifting device 11 is mounted by bearings on the frame 46 of the belt arrangement 7 and is connected by means of connecting elements, for instance in the form of a jointed rod 48, with the frame 46. In order to slide the carriage 42 lateral lead screws 49 are provided which are able to be driven by a motor or, as shown in FIG. 5, manually by means of a shaft provided with a handwheel 50. The longitudinal shaft 34, from which the drive of the lifting device 11 is taken, which is able to be adjusted with the carriage 42, is, as shown in FIG. 7 as well, in the form of a polygonal shaft, on which the drive element 51 associated with the lifting device 11 can slide. The drive element 51** may be mounted on a bearing lug mounted on the sliding frame.

The lifting device 11 illustrated in FIG. 2 and furthermore in FIGS. 6 and 7, consists of cam disks 53 mounted on a shaft 52, able to be driven by the longitudinal shaft 34, such disks being arranged between the belts of the belt arrangement 7 serving as the drag device. Outside their actual disk cam the cam disks 53 have such a diameter that they do not extend above the belts of the belt arrangement 7. It is only when the cam **53*a* is moved to the top that it extends past the surface of the belts so that the sheet thereover is patted or pushed upwards. The shaft 52 extends through longitudinal slots 54 in the frame of the belt arrangement 7, something that renders possible the desired adjustability. The cam disks 52 are so driven that their periphery rolls along the sheets at approximately the speed of the sheets. Accordingly the circumferential speed of the cam disks 53 where the cam 53*a* is active in pushing the sheet upwards is accordingly equal approximately to the increased conveying speed of the belts of the belt arrangement 7. In place of the cam disks it would naturally be possible to use other upwardly pushing elements, for instance in the form of pivoting joggers. Furthermore it would be possible to use blowing nozzles in addition to the pushing means or as an alternative thereto, as illustrated in FIG. 2 at 55. They may, as shown in FIG. 2 in broken lines, be pivoting and cooperate with a baffle 56 in such a manner that only in the condition not covered by the baffle 56 would it be possible for an air jet to be directed onto an overlying sheet. Such an arrangement offers the advantage that the blowing nozzles 55** may be permanently fed with air.

Furthermore it would be possible as well to additionally or as an alternative to the lifting device working from below to have a device operating from above. Such a device would then have to be designed in the form of a suction device able to be pivoted up and down. For this purpose it would be possible to provide a braking device pivoting up and down in step with the arriving sheets and arranged upstream from the braking device **10*b* in the form of a suction beating lever, which has suction elements which are connected with the vacuum source and are able to be moved up and down by a crank drive. However it would readily be possible to design the braking device itself in the form of a lifting device if the suction box 36** associated with the braking device together with the associated suction belts is arranged to be swung up and down. However the embodiment of the invention based on the examples as shown in the figures with the vertically stationary braking device does have the advantage of a high degree of freedom from vibration.

Figure 8:
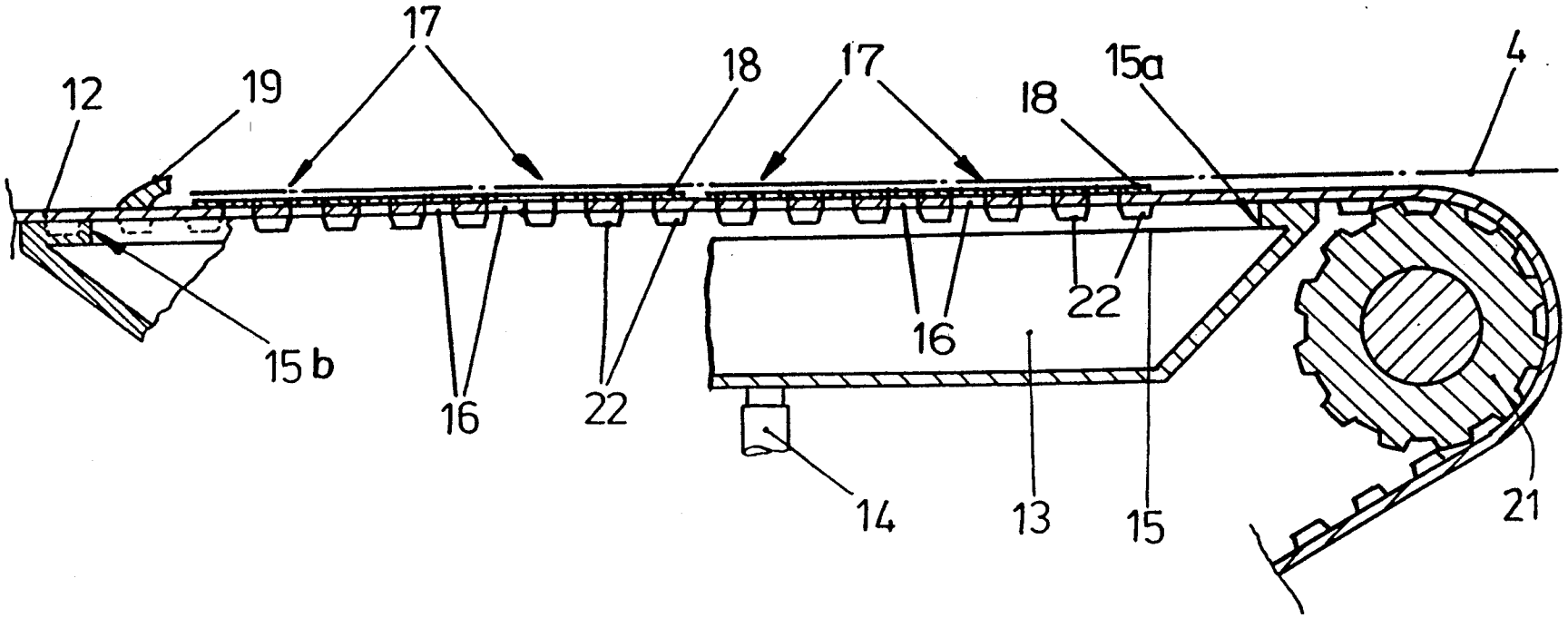
FIG. 8 is a longitudinal section taken through a suction belt of the drag device in accordance with the invention.

According to an alternate embodiment shown in FIG. 8, a plurality of suction hole groups 17 may be provided. As shown in FIG. 8, two such groups are included.

We claim:

1. A device for the formation of an overlapping stream of sheets while conveying sheets cut by a preceding transverse cutter device from a web of paper to a feed table of a paper processing machine, comprising:

a drag device comprising a belt arrangement, said belt arrangement including circulating entraining means defining a leading edge, said entraining means adapted for engagement of consecutively moving sheets at the leading edge thereof;

a draw off device located following said belt arrangement;

means to drive the draw off device at the same speed as the overlapping stream;

a holding up device located above said belt arrangement, said holding up device and said belt arrangement defining a gap for the passage of sheets, said holding up device including a brake device with circulating holding means, said brake device adapted for engagement with the trailing ends of consecutively moving sheets;

a lifting device associated with said belt arrangement; and means to drive the lifting device at the same speed as the conveying speed of the entraining means, wherein:

said holding means is adapted to be driven at an adjustable speed which initially is equal to the conveying speed of the entraining means and is thereafter reduced to be equal to the speed of the overlapping stream.

2. The device as defined in claim 1, further comprising:

means to drive the belt arrangement, further wherein:

said belt arrangement has a plurality of belts driven by said means to drive the belt arrangement at a varying speed along a circuit starting with a speed equal to the speed of the arriving sheets, then a speed greater than the starting speed followed by a speed resulting in synchronization of said entraining means with the arriving sheets.

3. The device as defined in claim 2, further wherein:

said belt arrangement comprises at least two belt sets driven by said means to drive the belt arrangement independently of each other but offset in time; and the entraining means of each belt set are alternately brought into engagement with sheets such that the sheets associated with each belt set are engaged successively.

4. The device as defined in claim 3, further comprising:

a bend wheel associated with each belt set, further wherein:

said belt arrangement further comprises a driven shaft associated with each belt set, each said driven shaft having a bend wheel of the other belt set mounted thereon to be freely rotatable; and said means to drive the belt arrangement of each belt set includes a drive wheel mounted on a respective driven shaft.

5. The device as defined in claim 4, further wherein:

said means to drive the belt arrangement of each belt set further includes an associated variable speed motor.

6. The device as defined in claim 1, further wherein:

said belt arrangement has a plurality of belts comprising suction belts each provided over a part of their periphery with suction holes arranged in at least one group of holes, said group having a length of approximately 200 mm.

7. The device as defined in claim 6, further wherein:

a plurality of groups of suction holes are provided evenly spaced over the periphery of the belt.

8. The device as defined in claim 6, further wherein:

each belt includes projecting parts on their surface adjacent to the group of suction holes.

9. The device as defined in claim 6, further wherein:

each suction belt has a suction duct associated therewith, said suction duct defining a slot associated with the suction holes, said slot having a greater extent than any of the suction holes.

10. The device as defined in claim 1, further wherein:

said belt arrangement has a plurality of belts each provided with upwardly projecting repelling humps preceding their entraining means.

11. The device as defined in claim 1, further wherein:

said belt arrangement has a plurality of belts each formed as a gear belt with inwardly directed lateral rows of teeth, thereby insuring a positive drive for said belts.

12. The device as defined in claim 11, further wherein:

said plurality of belts comprising suction belts with suction holes therein, and a suction duct associated with each suction belt and in communication with the suction holes; and each suction duct is flanked by sealing strips which are arranged in lateral grooves provided for the lateral rows of teeth on the suction belts.

13. The device as defined in claim 12, further comprising:

vacuum decreasing means, further wherein:

the suction duct comprises a plurality of chambers along its length; and the vacuum decreasing means causes a decrease in the vacuum associated with the chambers.

14. The device as defined in claim 1, further wherein:

said draw off device comprises a driven drive roller and a mating roller resiliently pressed against the driven drive roller with a nip gap defined between the rollers; and said belt arrangement has a plurality of belts arranged at a lower level than the nip gap.

15. The device as defined in claim 1, further wherein:

said brake device comprises circulating driven suction belts provided with suction holes over their entire periphery.

16. The device as defined in claim 15, further wherein:

the suction belts of said brake device comprise gear belts with inwardly directed teeth, thereby insuring a positive drive for said suction belts.

17. The device as defined in claim 15, further wherein:

said brake device further comprises a suction box, a vacuum source connected with said suction box, said suction box having a bottom plate provided with openings over which the suction belts of the brake device run.

18. The device as defined in claim 1, further comprising:

a variable speed motor for driving said braking device.

19. The device as defined in claim 1, further wherein:

said holding up device comprises a suction box which is stationary during operation and follows said braking device.

20. The device as defined in claim 19, further wherein:

said brake device comprises circulating driven suction belts each defining a working plane;

the suction box of said holding up device defines a working plane; and the working plane of the suction belts of said brake device and the working plane of suction box of said holding up device are in alignment.

21. The device as defined in claim 1, further wherein:

the holding up device and the lifting device are adjustable together in accordance with the format of the sheets.

22. The device as defined in claim 1, further comprising:

a common pivot frame, further wherein:

the holding up device is mounted on the common pivot frame to be pivoted upwards about a lateral pivot axis.

23. The device as defined in claim 1, further wherein:

the brake device and associated lifting device are vertically fixed during operation.

24. The device as defined in claim 1, further wherein:

said belt arrangement has a plurality of belts; and the lifting device comprises lifting elements in the form of cam disks which are situated between the belts of the belt arrangement, said cam disks being driven at a circumferential speed equal to that of the belt arrangement.

* * * * *